United States Patent [19]

Jones

[11] Patent Number: 5,042,259

[45] Date of Patent: Aug. 27, 1991

[54] HYDRIDE HEAT PUMP WITH HEAT REGENERATOR

[75] Inventor: Jack A. Jones, Los Angeles, Calif.

[73] Assignee: California Institute of Technology, Pasadena, Calif.

[21] Appl. No.: 598,505

[22] Filed: Oct. 16, 1990

[51] Int. Cl.[5] ..... F17C 11/00

[52] U.S. Cl. ..... 62/46.2; 62/467; 165/104.12

[58] Field of Search ..... 62/46.2, 467; 165/104.12

[56] References Cited

U.S. PATENT DOCUMENTS

| | | | |
|---|---|---|---|
| 4,188,795 | 2/1980 | Terry | 62/467 |
| 4,372,376 | 2/1983 | Nelson et al. | 165/104.12 |
| 4,402,187 | 9/1983 | Golben | 62/46.2 |
| 4,436,539 | 3/1984 | Ron et al. | 62/4 |
| 4,523,635 | 6/1985 | Nishizaki et al. | 62/467 |
| 4,623,018 | 11/1986 | Takeshita et al. | 165/104.12 |
| 4,875,346 | 10/1989 | Jones et al. | 62/467 |
| 4,928,496 | 5/1990 | Wallace et al. | 62/467 |

OTHER PUBLICATIONS

Design & Component Test Performance of an Efficient 4W, 130K Sorption Refrigrator, Adavances In Cryogenic Eng., vol. 35, p. 1367 (Jun. 1990).

High Efficiency Sorption Refrigerator Design, Advances In Cryogenic Eng., vol. 35, p. 1375 (Jul. 1990).

Metal Hydride Solar Heat Pump & Power System (HYCSOS), AIAA/ASERC Conference On Solar Energy, Tech. Status, #78-1762 (May 1978).

*Primary Examiner*—Ronald C. Capossela

*Attorney, Agent, or Firm*—F. Eugene Logan

[57] ABSTRACT

A regenerative hydride heat pump process and system is provided which can regenerate a high percentage of the sensible heat of the system. A series of at least four canisters containing a lower temperature performing hydride and a series of at least four canisters containing a higher temperature performing hydride is provided. Each canister contains a heat conductive passageway through which a heat transfer fluid is circulated so that sensible heat is regenerated. The process and system are useful for air conditioning rooms, providing room heat in the winter or for hot water heating throughout the year, and, in general, for pumping heat from a lower temperature to a higher temperature.

32 Claims, 6 Drawing Sheets

260
102D
128
156D
104D
140D
118D
116D
120D
124
102C
116C
158
104C
118C
120C
124
102B
116B
104B
118B
152
124
102A
120B
116A
266
104A
118A
126
120A
272
268

202D
256D
240D
216D
218D
224
220D
202C
258
216C
218C
202B
224
220C
216B
218B
252
202A
264
224
220B
216A
218A
270
226
220A
274
262

HYDRIDE HEAT PUMP WITH HEAT REGENERATOR

ORIGIN OF INVENTION

The invention described herein was made in the performance of work under a NASA Contract, and is subject to the provisions of Public Law 96-517 (35 USC 202) in which the Contractor has elected to retain title.

BACKGROUND OF THE INVENTION

1. Technical Field

This invention is directed towards regenerative hydride heat pump system and process.

2. Discussion of the Invention

Conventional dual metal hydride heat pumps comprise canisters containing two chemically different hydrides, one canister operates over a relatively lower temperature range, and the other canister operates over a relatively higher temperature range. The first or lower temperature performing hydride cools greatly, when providing hydrogen to the second or higher temperature performing hydride, and therefore can be used as a heat sink for cooling a room. The second or higher temperature performing hydride, when heated by an external source of heat desorbs hydrogen, which is used as a hydrogen source to the lower temperature performing hydride. Since higher temperature performing hydride take up hydrogen when cooled and desorb the hydrogen when heated, the higher temperature performing hydride side is heat driven usually by a relatively inexpensive source of heat such as natural gas or waste heat.

If the lower and higher temperature performing hydride canisters are cycled merely by exhausting their heat to the environment, no heat is regenerated. Consequently some regeneration schemes thermally link two low temperature canisters to each other and two high temperature canisters to each other thereby halving the sensible heat requirements. Net heating and cooling is then required to bring the canisters to the next required cycling temperatures. Unfortunately regeneration schemes such as this have raised the coefficient of performance or COP of hydride heat pumps to only about 0.5 to 0.6, i.e. for every 1000 watts of heat delivered to the hydride heat pump only 500 to 600 watts of heat is removed at a lower temperature. If the system were able to regenerate all of the sensible heat, the COP would be almost 1.0. It is therefore desirable to regenerate more of the sensible heat in hydride heat pumps.

In air conditioning systems the efficiency of the apparatus is usually measured by its coefficient of performance or "COP". By the term "COP" as used herein is meant the ratio of heating or cooling work performed divided by the amount of power required to do the work. Since cooling is generally the primary object of heat pumps, many systems are rated on their cooling COPs.

U.S. Pat. No. 4,372,376 discloses a hydride heat pump system which regenerates heat by a rotating valve device for each hydride which causes the heat transfer fluid to be directed to a particular bed or beds. It is disclosed that in operation the system, with a cycle time of about 4 minutes, a total hydride weight of about 82 kg (180 lbs), an output of 14.6 kw (50,000 BTU/hr) is obtained with a COP of about 1.5.

U.S. Pat. No. 4,436,539 discloses a dual hydride heat pump driven by waste heat for air conditioning buses which requires at least two vessels containing the higher temperature performing hydride and at least two vessels containing the lower temperature performing hydride. Water is used as the heat transfer fluid. It is mentioned that such units would weigh 445 kg and have a cooling capacity of 24.6 kw (84,000 BTU/hr) and be comparable to the weight of conventional bus air conditioning units. Since waste heat from the bus is used as the source of heat, heat regeneration is not a primary concern in this system.

Cryogenic heat regenerative cooler systems for sorption refrigerators using a physical, as opposed to chemical or hydride, sorption system having a heating/cooling loop and an expansion valve, with methane as a refrigerant gas and charcoal as the adsorbent, are disclosed in articles entitled "High Efficiency Sorption Refrigerator Design", and, "Design and Component Test Performance of an Efficient 4 W, 130 K Sorption Refrigerator" in Advances In Cryogenic Engineering, Vol. 35, Plenum Press, New York, 1990. Desorption occurs at 4.46 MPa (646 psia), i.e. $P_H$, and adsorption at 0.15 MPa (22 psia), i.e. $P_L$, or a pressure ratio of about 30, i.e. $P_H/P_L=30$. Methane is expanded from 4.46 MPa to 0.15 MPa to achieve cooling below 130 K (−143° C.). The sorbent is heated from 240 K (−33° C.) to 600 K (327° C.) to desorb the methane.

SUMMARY OF THE INVENTION

It is an objective of this invention to provide a system and process improving the efficiency of regenerative hydride heat pump operations. It is also an object of this invention to provide a system and process for regenerating a large portion of the sensible heat.

By the term "sensible heat" as used herein is meant the "mass" times "specific heat" times "temperature change". Therefore, unless otherwise specified, the term "sensible heat" as used herein does not include latent heat or heat of adsorption or chemisorption.

Another object of this invention is to provide a regenerative hydride heat pump system and process having an enhanced coefficient of performance. Still another object of this invention is to provide a regenerative sorbent heat pump system and process which can be used for cooling chambers, rooms or interior spaces. Yet another object of this invention is to provide such systems and processes which can operate using hydride/hydrogen gas systems which have very low or no atmospheric ozone-depletion-potential or "ODP". It is a further object of this invention to provide a system which can be used for heating and cooling rooms and buildings in which the heating can be for comfort or space heating in the winter or for producing hot water year around.

Accordingly there is provided by the principles of this invention a regenerative temperature hydride heat pump process for cooling a chamber, room or interior space which comprises confining a first or lower temperature performing hydride in a plurality of first reaction zones and maintaining the temperatures thereof in a first temperature range, and introducing hydrogen gas from a source of hydrogen gas into a predetermined one of the first reaction zones and sorbing the hydrogen gas on the first hydride therein. The number of first reaction zones being at least four and preferably six. The process also comprises desorbing hydrogen gas from the first hydride in another predetermined one of the first reaction zones, and removing the desorbed hydrogen gas therefrom. The process includes transferring heat between the first reaction zones by circulating a first heat transfer fluid in series flow around a loop of the first reaction zones, thereby regenerating heat, while preventing the first heat transfer fluid from directly contacting the first hydride. The process also includes transferring or rejecting heat from the predetermined one of the first reaction zones to the environment or other heat sink which can be for heating water year around or heating a room in the winter. The process further includes transferring heat from a chamber, room or interior space to the another predetermined one of the first reaction zones thereby cooling such space and aiding the desorption of the first hydride therein.

The process further comprises confining a second or higher temperature performing hydride in a plurality of second reaction zones and maintaining the temperatures thereof in a second temperature range which is higher than the first temperature range. The number of second reaction zones being equal to the number of first reaction zones. The process also includes introducing the desorbed hydrogen gas removed from the another predetermined one of the first reaction zones into a predetermined one of the second reaction zones and sorbing the hydrogen gas on the second hydride therein; and, desorbing hydrogen gas from the second hydride in another predetermined one of the second reaction zones by heating and removing the desorbed hydrogen gas therefrom and using it as the source of hydrogen gas introduced into the predetermined one of the first reaction zones. The process includes transferring heat between the second reaction zones by circulating a second heat transfer fluid in series flow around a loop of the second reaction zones, thereby regenerating heat, while preventing the second heat transfer fluid from directly contacting the second hyride. The process also includes transferring heat from the predetermined one of the second reaction zones to the environment or other heat sink which can be for heating water year around or heating a room in the winter. The process further includes transferring or adding heat from a heat source to the another predetermined one of the second reaction zones. The combination of transferring hydrogen gas between low temperature and high temperature reaction zones and circulating a heat transfer fluid through such zones provides a highly efficient regenerative temperature hydride heat pump process for cooling a chamber, room or interior space which is superior to existing hydride based systems.

In one embodiment of this invention the process comprises, after a predetermined period of time which define a phase of the process, (i.) advancing the predetermined one of the first reaction zones to the next first reaction zone in the group of first reaction zones, (ii.) advancing the another predetermined one of the first reaction zones to the next first reaction zone in the group of first reaction zones, (iii.) advancing the predetermined one of the second reaction zones to the next second reaction zone in the group of second reaction zones, and (iv.) advancing the another predetermined one of the second reaction zones to the next second reaction zone in the group of second reaction zones; and, thereafter repeating such advancing of the first and second reaction zones around the group of such zones after the predetermined period of time.

In another embodiment the transferring of heat from the predetermined one of the first reaction zones to the environment or heat sink comprises transferring heat from the predetermined one of the first reaction zones to a third heat transfer fluid; and, transferring heat from the third heat transfer fluid to the environment or heat sink. In still another embodiment the transferring of heat from the predetermined one of the first reaction zones comprises transferring heat from the first heat transfer fluid before, and proximate to, flowing it into the predetermined one of the first reaction zones to a third heat transfer fluid thereby producing a cooled first heat transfer fluid for flowing into the predetermined one of the first reaction zones; and, transferring heat from the third heat transfer fluid to the environment or heat sink.

In one embodiment the transferring of heat from the chamber, room or interior space to the another predetermined one of the first reaction zones comprises transferring heat from such space to a third heat transfer fluid; and, transferring heat from the third heat transfer fluid to the another predetermined one of the first reaction zones. In still another embodiment the transferring of heat from such space comprises transferring heat from such space to a third heat transfer fluid; and, transferring heat from the third heat transfer fluid to the first heat transfer fluid before, and proximate to, flowing it into the another predetermined one of the first reaction zones thereby producing a heated first heat transfer fluid for flowing into the another predetermined one of the first reaction zones.

In yet another embodiment of this invention the transferring of heat from the predetermined one of the second reaction zones to the environment or heat sink comprises transferring heat from the predetermined one of the second reaction zones to a third heat transfer fluid; and, transferring heat from the third heat transfer fluid to the environment or heat sink. In yet a further embodiment the transferring such heat from the predetermined one of the second reaction zones comprises transferring heat from the second heat transfer fluid before, and proximate to, flowing it into the predetermined one of the second reaction zones to a third heat transfer fluid thereby producing a cooled second heat transfer fluid for flowing into the predetermined one of the second reaction zones; and, transferring heat from the third heat transfer fluid to the environment or heat sink.

In one embodiment the transferring of heat from a heat source to the another predetermined one of the second reaction zones comprises transferring heat from the heat source to the second heat transfer fluid before, and proximate to, flowing it into the another predetermined one of the second reaction zones. In another embodiment the transferring such heat from the heat source comprises transferring heat from the heat source to a third heat transfer fluid; and, transferring heat from the third heat transfer fluid to the another predetermined one of the second reaction zones. In still another embodiment the transferring such heat from the heat source comprises transferring heat from the heat source to a third heat transfer fluid; and, transferring heat from the third heat transfer fluid to the second heat transfer fluid before, and proximate to, flowing it into the another predetermined one of the second reaction zones thereby producing a heated second heat transfer fluid for flowing into the another predetermined one of the second reaction zone.

In one embodiment of this invention the first hydride is FeTiH and the second hydride is LaNi4.7Al0.3H3.

Other non-limiting examples of metal hydrides useful for this invention are FeTi, Fe0.9Mn0.1Ti, Fe0.8Ni0.2Ti, CaNi5, Ca0.7M0.3Ni5, Ca0.2M0.8Ni5, MNi5, LaNi5, LaNi4.7Al0.3, MNi4.5Al0.5, MNi4.15Fe0.85, Mg2Ni, Mg2Cu and Mg, where "M" is misch metal.

There is also provided by the principles of this invention a regenerative temperature hydride heat pump system for cooling a chamber, room or interior space comprising a plurality of first or low temperature canisters. The number of first canisters is at least four. Each of the first canisters has a first or lower temperature performing hydride contained therein, and a first heat conductive passageway for indirectly transferring heat between the first hydride and a heat transfer fluid in the passageway without direct contact between the heat transfer fluid and the first hydride.

In this embodiment the system also includes a plurality of first indirect heat exchange means. The number of first indirect heat exchange means is equal to the number of first canisters. Each of the first indirect heat exchange means has a first and second channels for flowing a heat transfer fluids. The channels are isolated from fluid communication with each other but in heat conductive communication with each other. Each of the channels has an inlet and an outlet.

The system includes a first train formed by connecting in alternating order the first channels of the first indirect heat exchange means to the first heat conductive passageways. The system also includes first pumping means for pumping a first heat transfer fluid around the first train; and connecting means for connecting the outlet of a second pumping means to the inlet of the second channel of each of the first internal heat exchange means, and the outlet of each of the second channels thereof to the inlet of the second pumping means. Control means is included for directing the second heat transfer fluid to the second channel of a predetermined one of the first indirect heat exchange means at the beginning of a phase; first heat discharge means for transferring heat from the second heat transfer fluid to the environment or heat sink; and, chamber cooling means for transferring heat from a chamber, room or interior space to each of the first canisters in a predetermined order.

The system further comprises a plurality of second or high temperature canisters. The number of second canisters is equal to the number of first canisters. Each of the second canisters has a second or higher temperature performing hydride contained therein which requires a higher temperature for desorption of hydrogen gas than the temperature for desorption of hydrogen gas from the first hydride. The system includes a second heat conductive passageway for indirectly transferring heat between the second hydride and a heat transfer fluid in the second heat conductive passageway without direct contact between the heat transfer fluid therein and the second hydride. Means is also included for transferring hydrogen gas between the first or low temperture canisters and the second or high temperature canisters.

The system also includes a plurality of second indirect heat exchange means. The number of second indirect heat exchange means is equal to the number of second canisters. Each of the second indirect heat exchange means has a first channel and second channels for flowing heat transfer fluids. Such channels are isolated from fluid communication with each other but in heat conductive communication with each other. Each of the channels has an inlet and an outlet.

The system includes a second train formed by connecting in alternating order the first channels of the second indirect heat exchange means to the second heat conductive passageways. The system also includes third pumping means for pumping a third heat transfer fluid around the second train; and connecting means for connecting the outlet of a fourth pumping means to the inlet of the second channel of each of the second indirect heat exchange means, and the outlet of each of the second channels thereof to the inlet of the fourth pumping means. Control means is included for directing the fourth heat transfer fluid to the second channel of a predetermined one of the second indirect heat exchange means at the beginning of a phase. The system also includes second heat discharge means for transferring heat from the fourth heat transfer fluid to the environment or heat sink; and, heating means for transferring heat to each of the second canisters in a predetermined order. The system as described provides an efficient regenerative temperature hydride heat pump system operable for cooling a chamber, room or interior space.

In one embodiment the number of first canisters is four and the number of second canisters is four. In another embodiment the number of first canisters is six and the number of second canisters is six.

In one embodiment the first and second heat discharge means are radiators.

In one embodiment the chamber cooling means comprises means for transferring heat from the chamber, room or interior space to a fifth heat transfer fluid; and, means for transferring heat from the fifth heat transfer fluid to a predetermined one of the first canisters. In one embodiment the chamber cooling means further comprises means for transferring heat from the fifth heat transfer fluid to the first heat transfer fluid; and, means for transferring heat from the first heat transfer fluid to a predetermined one of the first canisters. In one another embodiment the each of the first indirect heat exchange means has a third channel for flowing a heat transfer fluid, the third channel is isolated from fluid communication with the first and second channels thereof, the first channel is in heat conductive communication with the third channel, and the third channel having an inlet and an outlet. This embodiment also includes connecting means for connecting the outlet of a fifth pumping means to the inlet of the third channel of each of the first internal heat exchange means, and the outlet of each of the third channels to the inlet of the fifth pumping means. The system includes control means for directing the third heat transfer fluid to the third channel of a predetermined one of the first indirect heat exchange means at the beginning of each phase; and the chamber cooling means includes means for transferring heat from the chamber, room or interior space to the fifth heat transfer fluid.

In one embodiment the heating means comprises means for heating a fifth heat transfer fluid; and, means for transferring heat from the fifth heat transfer fluid to a predetermined one of the second canisters. In another embodiment the heating means further comprises means for transferring heat from the fifth heat transfer fluid to the third heat transfer fluid; and, means for transferring heat from the third heat transfer fluid to a predetermined one of the second canisters. In still another embodiment each of the second indirect heat exchange means has a third channel for flowing a heat transfer fluid. The third channel is isolated from fluid communication with the first and second channels thereof. The third channel is in heat conductive communication with the first channel thereof and has an inlet and an outlet. This embodiment includes connecting means for connecting the outlet of a fifth pumping means to the inlet of the third channel of each of the second indirect heat exchange means, and the outlet of each of the third channels to the inlet of the fifth pumping means. The system also includes control means for directing the fifth heat transfer fluid to the third channel of a predetermined one of the second indirect heat exchange means at the beginning of a phase. The heating means includes means for heating the fifth heat transfer fluid.

In one embodiment of the system the first hydride is FeTiH and the second hydride is LaNi4.7Al0.3H3.

In one embodiment of this invention only one pump is required and the components of the system are connected together in series. The principal components are the plurality of first canisters, the plurality of first indirect heat exchange means, the first train, the plurality of second canisters, the means for transferring hydrogen gas between the first canisters and the second canisters, the plurality of second indirect heat exchange means, the second train, and the pumping means for pumping the heat transfer fluid around the closed loop of such components. The system includes control means for directing the heat transfer fluid to the second channel of a predetermined one of the first indirect heat exchange means; control means for directing the heat transfer fluid to the third channel of a predetermined one of the first indirect heat exchange means; control means for directing the heat transfer fluid to the second channel of a predetermined one of the second indirect heat exchange means; and control means for directing the heat transfer fluid to the third channel of a predetermined one of the second indirect heat exchange means. In this embodiment the system includes first connecting means for connecting the outlet of the second train to the inlet of the first train; second connecting means for connecting the outlet of the first train to the inlet of the third channel of each of the second indirect heat exchange means; third connecting means for connecting the outlet of the third channel of each of the second indirect heat exchange means to the inlet of the third channel of each of the first indirect heat exchange means; fourth connecting means for connecting the outlet of the third channel of each of the first indirect heat exchange means to the inlet of the second channel of each of the first indirect heat exchange means; fifth connecting means for connecting the outlet of the second channel of each of the first indirect heat exchange means to the inlet of the second channel of each of the second indirect heat exchange means; and sixth connecting means for connecting the outlet of the second channel of each of the second indirect heat exchange means to the inlet of the second train thereby forming a closed loop.

In this embodiment the second heat discharge means for transferring heat from the heat transfer fluid to the environment or heat sink is in the second connecting means; the heating means for introducing heat into the system includes means for heating the heat transfer fluid in the second connecting means; the room cooling means for transferring heat from a room to the heat transfer fluid is in the third connecting means; and the first heat discharge means for transferring heat from the heat transfer fluid to the environment or heat sink is in the fifth connecting means.

This embodiment also includes first auxiliary heat exchanger means for indirectly exchanging heat between the heat transfer fluid flowing in the first connecting means and the heat transfer fluid flowing in the second connecting means; second auxiliary heat exchanger means for indirectly exchanging heat between the heat transfer fluid flowing in the second connecting means and the heat transfer fluid flowing in the third connecting means; third auxiliary heat exchanger means for indirectly exchanging heat between the heat transfer fluid flowing in the second connecting means and the heat transfer fluid flowing in the sixth connecting means; and, fourth auxiliary heat exchanger means for indirectly exchanging heat between the heat transfer fluid flowing in the third connecting means and the heat transfer fluid flowing in the fourth connecting means.

In one embodiment the pumping means is in the second connecting means.

In one embodiment the second connecting means contains first, relative to the direction of flow of the heat transfer fluid therein, the first auxiliary heat exchanger means, then the third auxiliary heat exchanger means, then the second heat discharge means, then the pumping means, then the second auxiliary heat exchanger means, and last the heating means; and the third connecting means contains first, relative to the direction of flow of the heat transfer fluid therein, the second auxiliary heat exchanger means, then the fourth auxiliary heat exchanger means, and last the room cooling heating means.

In one embodiment the heat transfer fluid is selected from the group consisting of mixtures of diphenyl and diphenyl oxide, ortho-dichlorobenzene, ethylene glycol, methoxypropanol, and water. Examples of such heat transfer fluids are the Dowtherm TM fluids.

DESCRIPTION OF THE PREFERRED EMBODIMENTS

For illustrating the process and system of this invention a series of at least first or low temperature canisters 102 and a series of second or high temperature canisters 202 equal in number to the number of first canisters are described, see FIGS. 1,2 and 4–6, in which hydrogen gas is transferred between pairs of the first and second canisters by controlling their temperatures. Heat is regenerated by circulating heat transfer fluids through both sets of canisters. In the examples which follow the first canisters 102 contain a lower temperature performing hydride such FeTiH and the second canisters 202 contain a higher temperature performing hydride such as LaNi4.7Al0.3H3.

In general when the higher temperature performing hydride LaNi4.7,Al0.3,H3 is heated up to 110° C., hydrogen gas is driven off at about 10 atm hydrogen gas pressure. This hydrogen gas is then sorbed by the lower temperature performing hydride FeTiH which results in a large heat of reaction which is removed by radiators at about 50° C. When the higher temperature performing hydride is cooled from about 110° C. to about 50° C., it robs and resorbs the hydrogen gas from the lower temperature performing hydride which causes it to cool to about 0° C. at about 2 atm hydrogen gas pressure. Heat is transferred from a room to the lower temperature performing hydride in order to release more hydrogen gas demanded by the higher temperature performing hydride thereby causing cooling of the room.

Since the sensible heats to cycle the lower temperature performing hydride from 0° C to 50° C. and the higher temperature performing hydride from 50° C. to 110° C. are large, it is desirable to regenerate a large portion of these heats.

Sensible heats are regenerated in this invention by circulating a heat transfer fluid in series flow through the first or low temperature canisters and the second or high temperature canisters. Heat is rejected to the environment from both the low and high temperature canisters by radiators at about 50° C. It is estimated that 90% or more of the sensible heat can be regenerated by this invention.

Figure 1:
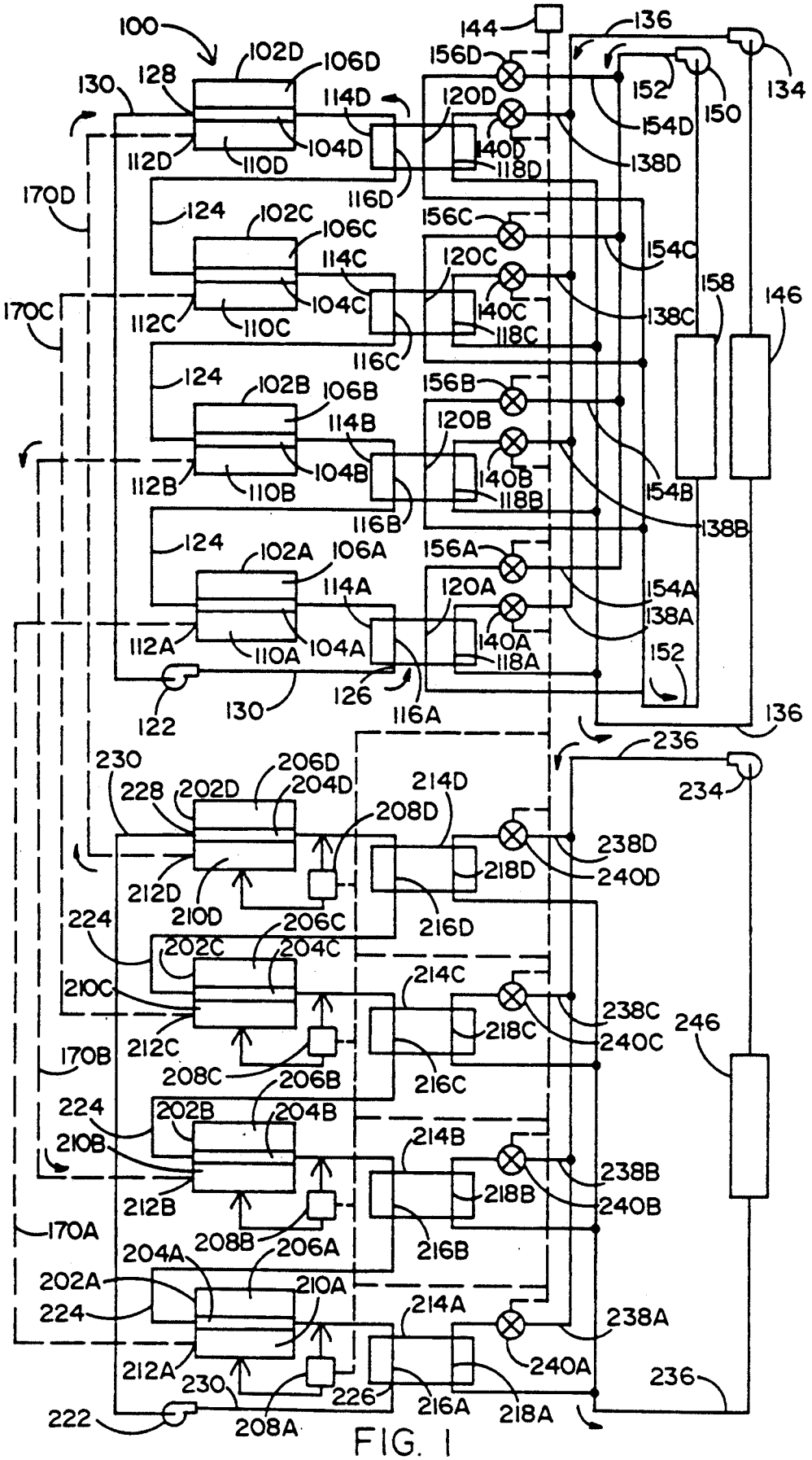
FIG. 1 is a diagram of a first embodiment of this invention having two trains of four canisters, two heat rejection loops and coolant loop.

Referring now to FIG. 1, a block diagram for a regenerative hydride heat pump system, generally designated by numeral 100, is shown for air conditioning, i.e. room heating and cooling. The system has four low temperature canisters 102A, 102B, 102C and 102D, having heat conductive passageways 104A, 104B, 104C, and 104D, respectively, and hydride chambers 106A, 106B, 106C, and 106D, respectively. The heat conductive passageways 104A–D are hermetically separated from chambers 106A–D, respectively. Chambers 106A–D contain a lower temperature performing hydride, sometimes referred to herein as the first hydride, 110A, 110B, 110C and 110D, respectively, and ports 112A, 112B, 112C and 112D, respectively, for flowing hydride gas into and out of the chamber, respectively. Hydrogen gas is sorbed or desorbed from the lower temperature performing hydride in each chamber depending on the temperature of the hydride in the particular chamber. The temperature of each chamber 106A–D is adjusted by adjusting the temperature of the heat transfer fluid, sometimes referred to herein as the first heat transfer fluid, flowing through the chamber heat conductive passageways 104A–D.

For each of the canisters 102A–D there is a corresponding indirect heat exchanger 114A, 114B, 114C and 114D, respectively sometimes referred to herein as the first indirect heat exchangers, having first channels 116A, 116B, 116C and 116D, respectively, second channels 118A, 118B, 118C and 118D, respectively, and third channels 120A, 120B, 120C and 120D, respectively. Within each heat exchanger 114A–D the first, second and third channels are hermetically separated from each other.

Pump 122, sometimes referred to herein as the first pumping means, conveys the first heat transfer fluid first into channel 116A, then into passageway 104A, then into channel 116B, then into passageway 104B, then into channel 116C, then into passageway 104C, then into channel 116D, then into passageway 104D, and then back to pump 122 whereupon the first heat transfer fluid is continuously recycled. As a consequence of the in series connecting of the first channels 116 to the heat conductive passageways 104 a train 124, sometimes referred to herein as the first train, of heat conductive passageways 104 is formed having a train inlet 126, which is also the inlet of first channel 116A, and, a train outlet 128, which is also the outlet of heat conductive passageway 104D. Train 124 when connected to pump 122 forms heat regeneration loop 130, sometimes referred to herein as the first heat regeneration loop. In embodiment 100 it should be noted that the order of heat conductive passageways and first channels always remains the same thereby eliminating the need for costly control valves in heat regeneration loop 130. This provides a cost saving and increased reliability over systems requiring control valves in the first heat regeneration loop 130.

Pump 134, sometimes referred to herein as the second pump means, pumps a heat transfer fluid, sometimes referred to herein as the second heat transfer fluid, through heat rejection loop 136, sometimes referred to herein as the first heat rejection loop, which comprises four parallel branches 138A, 138B, 138C and 138D having control valves 140A, 140B, 140C and 140D, respectively, and second channels 118A–D, respectively, of indirect heat exchangers 114A–D, respectively. Valves 140A–D are controlled by controller 144 so that only one of valves 140A–D is open at a time thereby permitting the second heat transfer fluid to flow through only one of second channels 118A–D at a time which will be explained in more detail later. Before returning to pump 134, the second heat transfer fluid is cooled by radiator 146 to about 40° C. and then continuously circulated around heat rejection loop 136 so that the active second channel always receives the second heat transfer fluid at a temperature of about 40° C. For example, in phase 1 valve 140D is open and all the other valves 140, i.e. valves 140A–C, are closed. Radiator 146 transfers heat from the second heat transfer fluid to the outside in the summer, and to the room or chamber to be heated in the winter, or to a hot water heater year around, in a conventional manner. In embodiment 100 it is to be noted that only one control valve 140 per canister is required for the heat rejection loop 136.

Pump 150, sometimes referred to herein as the third pump means, pumps a heat transfer fluid, sometimes referred to herein as the third heat transfer fluid, through room cooling loop 152 which comprises four parallel branches 154A, 154B, 154C and 154D having control valves 156A, 156B, 156C and 156D, respectively, and third channels 120A–D, respectively, of indirect heat exchangers 114A–D, respectively. Valves 156A–D are also controlled by controller 144 so that only one of valves 156A–D is open at a time thereby permitting the third heat transfer fluid to flow through only one of third channels 126A–D at a time which will be explained in more detail later. For example, in phase 1 valve 156B is open and all the other valves 156, i.e. valves 156A, C and D are closed. Before returning to pump 150, the third heat transfer fluid, which has been cooled to about 0° C. in canister 102B, is heated by room air in air conditioner blower 158 to about 10° C. and then continuously circulated around room cooling loop 152 so that the active third channel 120 always receives the third heat transfer fluid at a temperature of about 10° C. Blower 158 transfers heat from the room to the third heat transfer fluid in the summer, and to the outside environment in the winter, in a conventional manner. In embodiment 100 it is to be noted that only one control valve 156 per canister is required for the room cooling loop 152.

In a alternative embodiment heat exchangers 114 containing channels 116, 118 and 120, are replaced by four pair of indirect heat exchangers. One heat exchanger of each pair contains channels 116 and 118 and the other one of the pair contains an equivalent channel 116 and channel 120. Train 124 also contains equivalent channel 116.

In embodiment 100 as illustrated in FIG. 1, the system also has four high temperature canister 202A, 202B, 202C and 202D having heat conductive passageways 204A, 204B, 204C, and 204D, respectively, and hydride chambers 206A, 206B, 206C and 206D, respectively. The heat conductive passageways 204A-D are hermetically separated from chambers 206A-D, respectively. Each of canister 202A-D has a corresponding heating device 208A, 208B, 208C and 208-D, respectively, sometimes referred to herein as the primary heating means. Chambers 206A-D contain a higher temperature performing hydride, sometimes referred to herein as the second hydride, 210A, 210B, 210C and 210D, respectively, and ports 212A, 212B, 212C and 212D, respectively, for flowing hydrogen gas into and out of chambers 206A-D, respectively. The temperature of each chamber 206A-D is adjusted by heating devices 208A-D and by adjusting the temperature of the heat transfer fluid, sometimes referred to herein as the fourth heat transfer fluid, flowing through the chamber heat conductive passageways 204A-D.

For each of the canisters 202A-D there is a corresponding indirect heat exchanger 214A, 214B, 214C and 214D, respectively having first channels 216A, 216B, 216C and 216D, respectively, and second channels 218A, 218B, 218C and 218D, respectively. Within each heat exchanger 214A-D the first and second channels are hermetically separated from each other.

Pump 222, sometimes referred to herein as the fourth pumping means, conveys the fourth heat transfer fluid first into channel 216A, then into passageway 204A, then into channel 116B, then into passageway 204B, then into channel 216C, then into passageway 204C, then into channel 216D, then into passageway 204D, and then back to pump 222 whereupon the fourth heat transfer fluid is continuously recycled. As a consequence of the in series connecting of the first channels 216A-D to heat conductive passageways 204A-D a train 224, sometimes referred to herein as the second train, of heat conductive passageways 204 is formed having a train inlet 226, which is also the inlet of first channel 216A, and a train outlet 228, which is also the outlet of heat conductive passageway 204D.

In embodiment 100 it should be noted that the order of heat conductive passageways and first channels in second train 224 always remains the same thereby eliminating the need for costly control valves in heat regeneration loop 230, sometimes referred to herein as the second heat regeneration loop, which comprises train 224 and pump 222 thereby providing a cost saving and increased reliability over a system requiring control valves in the second heat regeneration loop 230.

The temperature of the hydride in each chamber is adjusted by the temperature of the fourth heat transfer fluid flowing through the particular chamber's heat conductive pasageways 204, and, when activated its heating device 208. Heating devices 208A-D can heat canisters 102A-D directly or, preferably, can heat the fourth heat transfer fluid proximate to flowing into heat conductive passageways 204A-D. Heating devices 208A-D are also controlled by controller 144 so that only one of the heating devices is heating at a time for a predetermined period of time. For example, in phase 1, heating device 208D is activated and heating the fourth heat transfer fluid from about 100° C. to about 110° C. while heating devices 208A-C are inactive. Controller 144 also maintains a heating cycle for heating devices 208A-D.

Pump 234, sometimes referred to herein as the fifth pump means, pumps a heat transfer fluid, sometimes referred to herein as the fifth heat transfer fluid, through heat rejection loop 236, sometimes referred to herein as the second heat rejection loop, which comprises four parallel branches 238A, 238B, 238C and 238D having control valves 240A, 240B, 240C and 240D, respectively, and second channels 218A-D, respectively, of second indirect heat exchangers 214A-D, respectively. Valves 240A-D are also controlled by controller 144 so that only one of valves 240A-D is open at a time thereby permitting the fifth heat transfer fluid to flow through only one of second channels 218A-D at a time which will be explained in more detail later. For example, in phase 1 valve 240D is open and all the other valves 240, i.e. valves 240A-C are closed. Before returning to pump 234, the fifth heat transfer fluid is cooled by radiator 246 from about 50° C. to about 40° C. and then continuously circulated around second heat rejection loop 236 so that the active second channel 218 always receives the fifth heat transfer fluid at a temperature of about 40° C. Radiator 246 transfers heat from the fifth heat transfer fluid to the outside in the summer, and to the room or chamber to be heated in the winter, or to a hot water heater year around, in a conventional manner. In embodiment 100 it is to be noted that only one control valve 240 per canister is required for the second heat rejection loop 236.

On the hydrogen gas side a series of conduits 170A, 170B, 170C and 170D connecting the low temperature or first hydride canisters to the high temperature or second hydride canisters provides means for transferring hydrogen gas between the low temperature and high temperature canisters.

Figure 2:
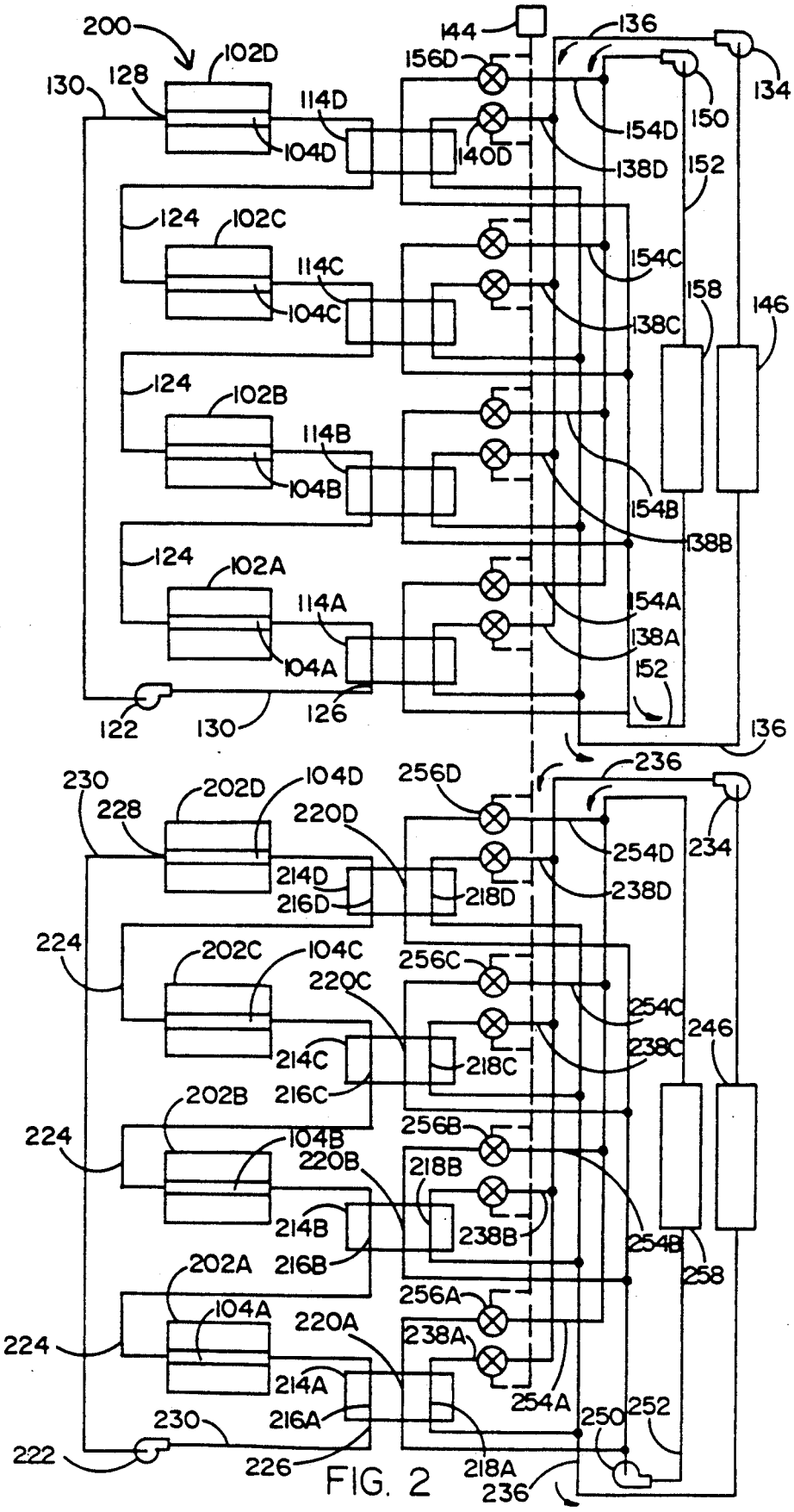
FIG. 2 is a diagram of a second embodiment of this invention having a heating loop.

Referring to FIG. 2, a diagram of a second embodiment of this invention, generally designated by numeral 200, with an alternative embodiment for the primary heating means. Embodiment 200 is identical to embodiment 100 except that heating devices 208A-D are replaced with indirect heat exchangers. For purposes of clarity only a few of the element numbers shown in FIG. 1 are repeated in FIG. 2 and in FIGS. 4-6. It is to be understood that the elements in FIGS. 2 and 4-6 which do not have element numbers are the same as in FIG. 1, and that elements with the same element numbers in the several figures are the same and perform the same function. As in embodiment 100, for each of the canisters 202A-D there is a corresponding indirect heat exchanger 214A, 214B, 214C and 214D, respectively having not only first channels 216A, 216B, 216C and 216D, respectively, and second channels 218A, 218B, 218C and 218D, respectively, but also third channels 220A, 220B, 220C and 220D, respectively. Within each heat exchanger 214A-D the first, second and third channels are hermetically separated from each other. Embodiment 200 also includes pump 250, sometimes referred to herein as the sixth pump means, for pumping a heat transfer fluid, sometimes referred to herein as the sixth heat transfer fluid, through heating loop 252 which comprises four parallel branches 254A, 254B, 254C and 254D having control valves 256A, 256B, 256C and 256D, respectively, and third channels 220A-D, respectively, of indirect heat exchangers 214A-D, respectively. Valves 256A-D are also controlled by controller 144 so that only one of valves 256A-D is open at a time thereby permitting the sixth heat transfer fluid to flow through only one of third channels 220A-D at a time. For example, in phase 1 valve 256D is open and all the other valves 256, i.e. valves 256A-C are closed. After pump 250, the sixth heat transfer fluid is heated by heater 258 from about 100° C. to about 110° C. and then continuously circulated around heating loop 252 so that the active third channel 220 always receives the sixth heat transfer fluid at a temperature of about 110° C. which then heats the fourth heat transfer fluid. Heater 258 heats the sixth heat transfer fluid in any effective conventional manner. In embodiment 200 it is to be noted that only one control valve 256 per canister is required for the heating loop 252.

In an alternative embodiment heat exchanger 214 containing channels 216, 218 and 220, are replaced by four pair of indirect heat exchangers. One heat exchanger of each pair contains channels 216 and 218 and the other one of the pair contains an equivalent channel 216 and channel 220. Train 224 also contains equivalent channel 216.

The number of phases equals the number of low temperature of first canisters. To further explain the phases, reference is made to Tables 1 and 2 and FIG. 3. Table 1 identifies, for each of the four phases of the process, which valves are open, which canisters are at their maximum or minimum temperature, and which canisters are receiving or discharging hydrogen gas. Table 2 with FIG. 3 identifies the nominal start and end temperature profile for each canister in each phase. For example to determine the nominal temperature profile in canister 202C at the end of phase 3, Table 2 shows that temperature profile H represents the nominal temperature profile along the length of the canister 202C. From FIG. 3 it is seen that profile H has a nominal temperature proximate the inlet of heat conductive passageway 204C of about 110° C., and, a nominal temperature proximate the outlet of heat conductive passageway 204C of about 50° C. Table 1 also shows that in phase 3 control valves 140B, 156D, 240D and 256B are open, that canister 102D is at its minimum temperature and sending hydrogen gas to canister 202D which is also at its minimum temperature, and, that canister 202B is at its maximum temperature and sending hydrogen gas to canister 102B which is also at its maximum temperature. Similarly, with regard to FIG. 1, Tables 2 and 3 and FIG. 3 apply. Table 3 identifies which heating device is activated and heating for each phase.

Figure 3:
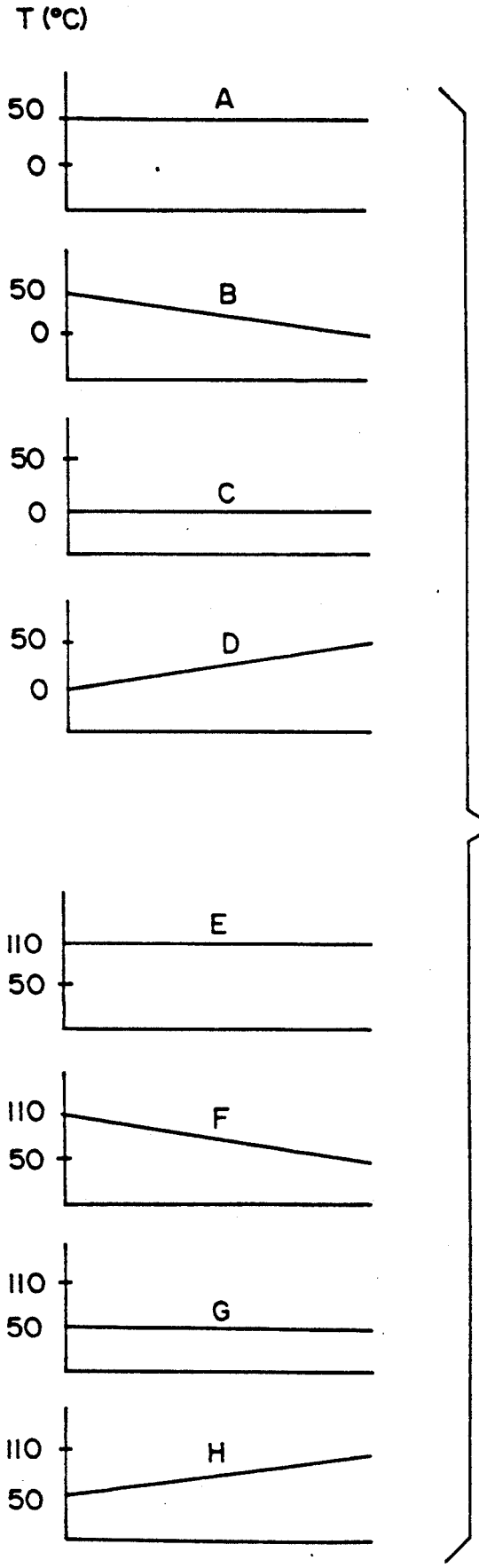
FIG. 3 is a diagram of temperature profiles in the canisters.

Although a straight line has been drawn from the inlet side temperature to the outlet side temperature in FIG. 3 it should be understood that some curvature may exist in the temperature profiles and that FIG. 3 represents nominal temperature profiles merely for purposes of illustrating the phases of the process.

Figure 4:
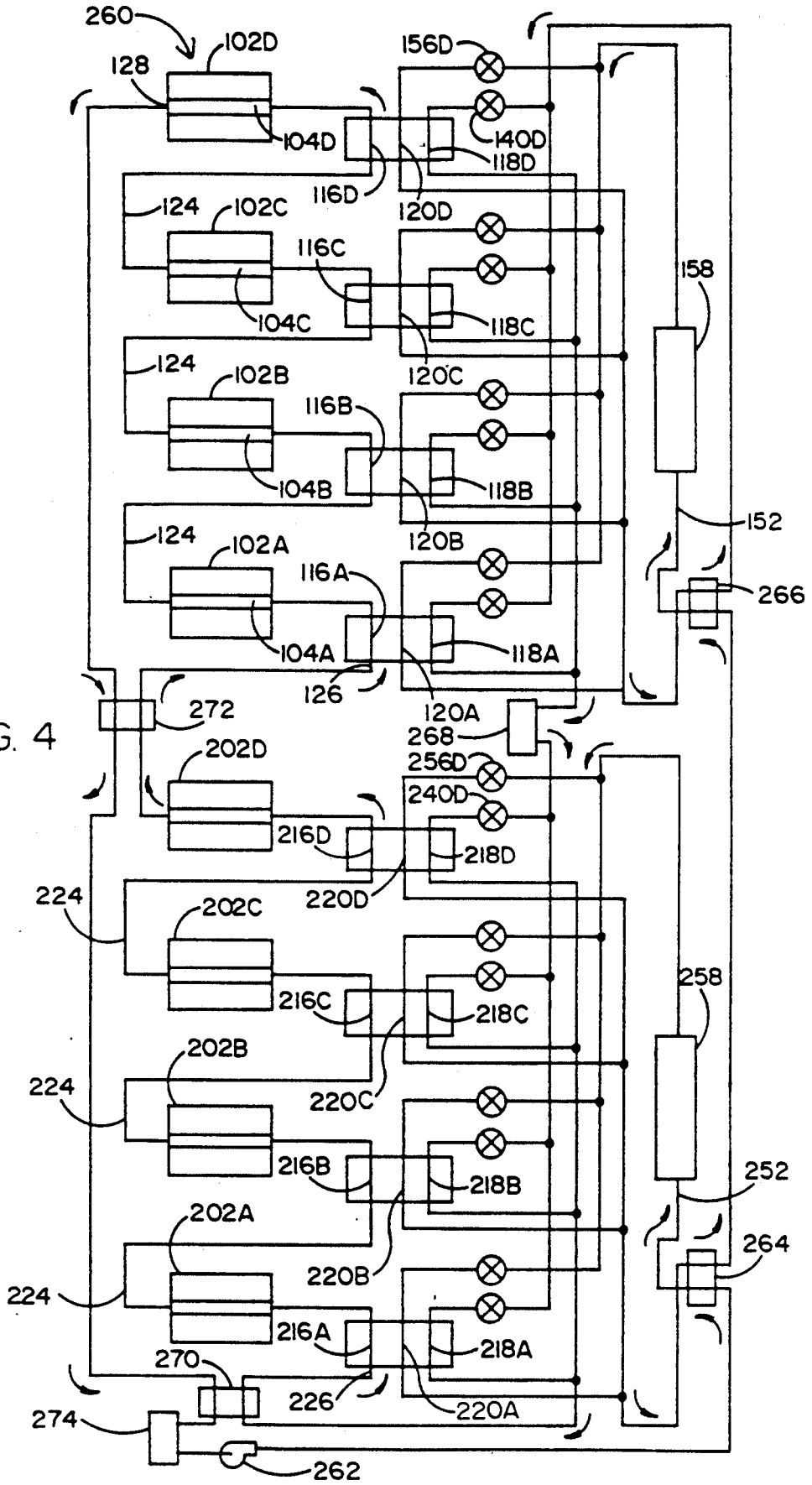
FIG. 4 is a diagram of a third embodiment of this invention having but one pump and one heat transfer fluid for the entire system.

FIG. 4 is a third embodiment of this invention generally designated by numeral 260 in which a single pump 262 conveys a single heat transfer fluid through a first heat regeneration leg, a first heat rejection leg, a room cooling leg, a second heat regeneration leg, a second heat rejection leg, and a heating leg. Specifically as shown in FIG. 4, pump 262 conveys a single heat transfer fluid through a heating leg containing, in part, indirect heat exchangers 264, heater 258 and third channels 220; then to a room cooling leg containing exchanger 264, indirect heat exchanger 266, air conditioner blower 158 and third channels 120; then to a first heat rejection leg containing exchanger 266 and second channels 118; then to a second heat rejection leg containing radiator 268 and second channels 218; then to a second heat regeneration leg containing indirect heat exchanger 270 and train 224 which contains first channels 216 and second heat conductive passageways 204; then to a first heat regeneration leg containing indirect heat exchanger 272, train 124 which contains first channels 116 and first heat conductive passageways 104; then back to the heating leg which also contains exchangers 272 and 270, radiator 274, and pump 262; whereupon it is continuously circulated in series through the legs. Radiators 268 and 274 cool the heat transfer fluid from about 50° C. to about 40° C. Heater 258 heats the heat transfer fluid from about 100° C. to about 110° C. and air conditioner blower 158 heats the heat transfer fluid from about 0° C. to about 10° C. A controller controls valve sets 140, 156, 240 and 256 in a manner identical to that described for controller 144 of embodiment 200 shown in FIG. 2. Embodiment 260 has the same four phases as described for embodiment 200.

Figure 5:
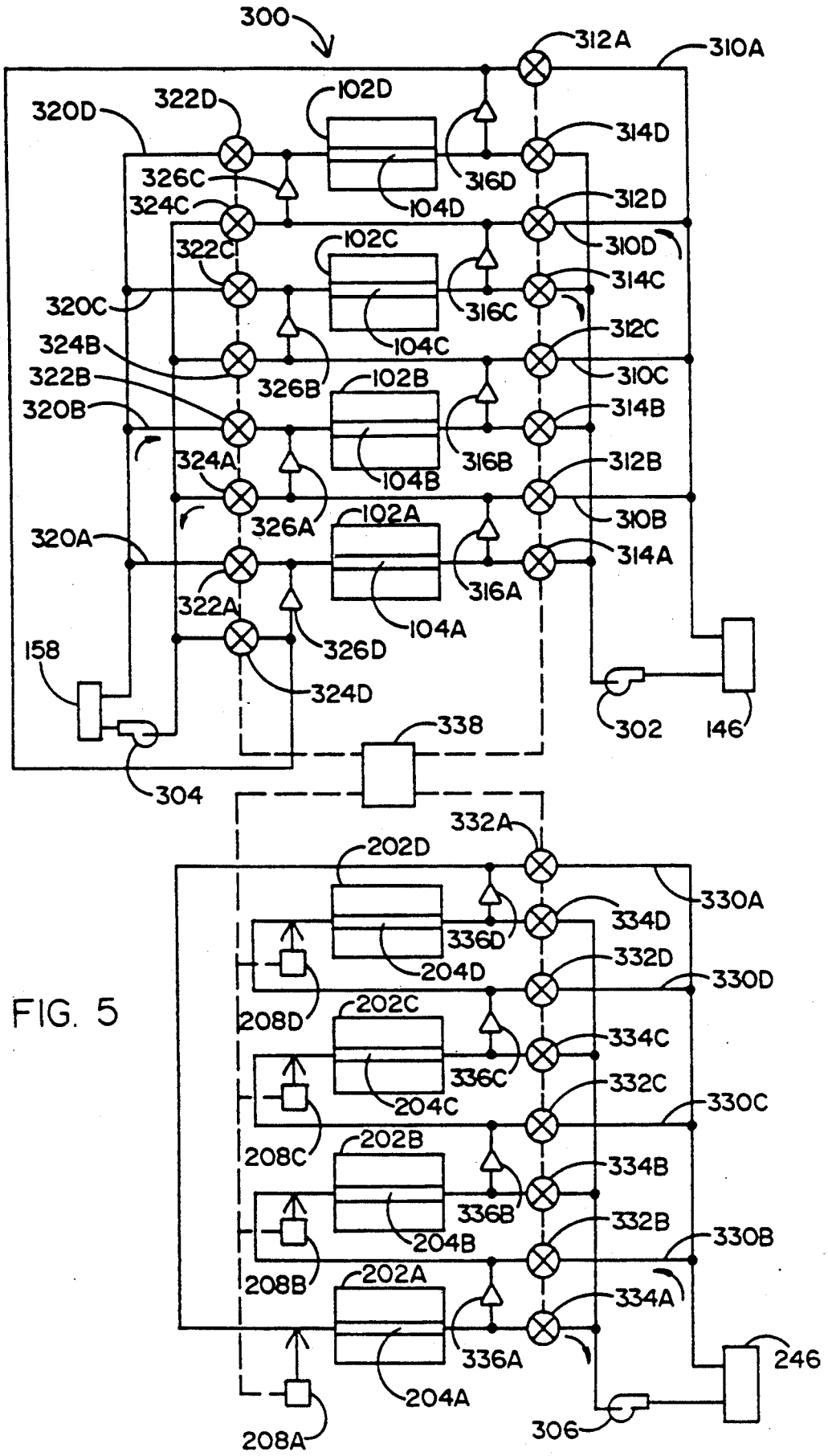
FIG. 5 is a diagram of a fourth embodiment of this invention having additional control valves that allow a first heat transfer fluid flow through the entire lower temperature performing hydride system, and having additional control valves that allow a second heat transfer fluid flow through the entire higher temperature performing hydride.

FIG. 5 is a fourth embodiment of this invention generally designated by numeral 300, in which a pair of pumps 302 and 304, in the lower temperature performing hydride half of the system, conveys a first heat transfer fluid in series flow through a first heat regeneration train, a first heat rejection leg, and an air conditioning room cooling leg. A third pump 306, in the higher temperature performing hydride side, conveys a second heat transfer fluid in series flow through a second heat regeneration train, a second heat rejection leg, and a heating leg. In this embodiment heat exchangers, such as indirect heat exchangers 114 and 214 used in the earlier described embodiments, are not required. In place of such heat exchangers sets of control valves and check valves are used which permit the first-in-the-series of heat conductive passageways in the train of heat conductive passageways, on both the lower and higher temperature performing hydride sides, to be advanced at the start of each phase to the next one of the passageways in the series.

As shown in FIG. 5, pump 302, on the lower temperature performing hydride side, conveys the first heat transfer fluid to a first heat rejection leg containing radiator 308, and four parallel branches 310A, 310B, 310C and 310D, which contain inlet control valves 312A, 312B, 312C and 312D, respectively, exit control valves 314A, 314B, 314C and 314D, respectively, and check valves 316A, 316B, 316C and 316D, respectively; then to half of the heat regeneration train containing half of the first heat conductive passageways 104; then to an air conditioning room cooling leg containing pump 304, air conditioner blower 158, and four parallel branches 320A, 320B, 320C and 320D, which contain inlet control valves 322A, 322B, 322C and 322D, respectively, exit control valves 324A, 324B, 324C and 324D, respectively, and check valves 326A, 326B, 326C and 326D, respectively; then to the remaining half of the first heat regeneration train containing the remaining half of passageways 104; and then back to pump 302. Only one control valve in each control valve set 312, 314, 322 and 324 is open in any phase.

Similarly pump 306, on the higher temperature performing hydride side, conveys the second heat transfer fluid to a second heat rejection leg containing radiator 246, and four parallel branches 330A, 330B, 330C and 330D, which contain inlet control valves 332A, 332B, 332C and 332D, respectively, exit control valves 334A, 334B, 334C and 334D, respectively, and check valves 336A, 336B, 336C and 336D, respectively; then to the second heat regeneration train containing second heat conductive passageways 204; and then back to pump 306. The second heat transfer fluid after flowing through half of passageways 204 is heated before entering the next passageway in the series of passageways 204 by heating devices 208 which is closest to the inlet of the next passageway. In embodiment 300, since there are four high temperature canisters 202, the second heat transfer fluid is heated by one of heating device 208 proximate to, and before entering, the third passageway in the series of passageways 204. Only one control valve in each control valve set 332 and 334 is open in any phase. Controller 338 controls valve sets 312, 314, 322, 324, 332 and 334 and heating devices 208 so that the proper valves are opened and the correct heating device is activated and heating in each phase. In the particular phase shown in FIG. 5, the open valves are 312D, 314C, 322B, and 324A, and the heating device which is heating is 208D. Small arrows indicate the flow through the open valves. To advance to then next phase from an existing phase the "A"s become "B"s, the "B"s become "C"s, "C"s become "D"s, and "D"s become "A"s.

Figure 6:
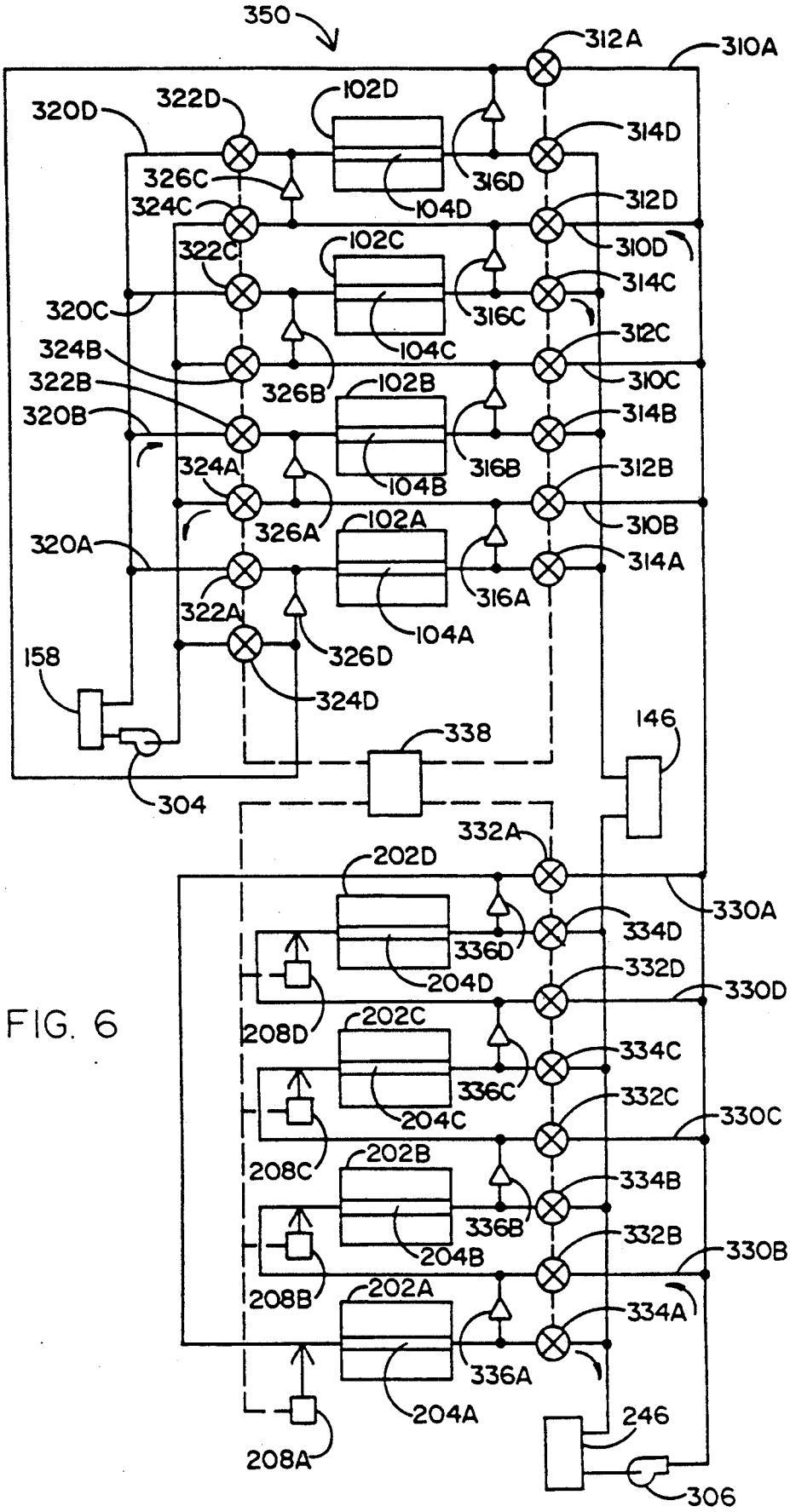
FIG. 6 is a diagram of a fifth embodiment of this invention having additional control valves that allow a single heat transfer fluid flow through the entire lower and higher temperature performing hydride system.

FIG. 6 is a fifth embodiment of this invention, generally designated by numeral 350, similar to FIG. 5 but with a single heat transfer fluid circulated through both the lower temperature performing hydride side and the higher temperature performing hydride side. In embodiment 350 pump 306 pumps a first portion of the heat transfer fluid to the lower temperature performing hydride side and a second portion of the heat transfer fluid to the higher temperature performing hydride side. Thus the lower and higher temperature performing hydride sides are in parallel with respect to the flow of heat transfer fluid from pump 306. As a result of the parallel flow pump 302 in FIG. 5 is not required. The other elements of embodiment 350 are the same as embodiment 300 including the operation of the control valves and heating devices and the advancing of phases. In the particular phase shown in FIG. 5, the open valves are 312D, 314C, 322B, 324A, 332B and 334A, and the heating device which is heating is 208D. Small arrows indicate the flow through the open valves.

In embodiments 300 and 350, radiators 146 and 246 cool the heat transfer fluid from about 50° C. to about 40° C. Heating devices 208 heats the heat transfer fluid from about 100° C. to about 110° C. and air conditioner blower 158 heats the heat transfer fluid from about 0° C. to about 10° C. Embodiments 300 and 350 have the same four phases as described for embodiment 200.

In an alternative embodiment of the system of FIGS. 6, the lower temperature performing hydride side and the higher temperature performing hydride side can be arranged in series flow with relationship to pump 306 by using the flow from radiator 146 as the feed to parallel branches 330 and the out flow from valves 334 as the feed to parallel branches 310.

In an alternative embodiment of the systems of FIGS. 5 and 6, pump 304 can be eliminated if the pressure drop between control valves 322 and 324 by way of passage through air conditioner blower 158 is less than the activation pressure drop for check valves 326.

In all embodiments the control valves are preferably solenoid valves.

Hydrogen gas conduits 170 are not shown in FIGS. 2 and 4–6 since they are identical to that of FIG. 1.

The primary heating means 208 has been generally indicated and discussed, however, means 208 can be any other suitable method of adding heat during a heating cycle to the high temperature canisters 204A–D.

In general the total number of phases will be equal to the number of first or low temperature canisters 104. The illustrated embodiments have four phases because there are four first canisters. It should be understood, however, that systems with six first or low temperature canisters are preferred to systems with four because more heat is regenerated.

Examples of useful heat transfer fluids are the Dowtherm TM brand fluids and water. Other heat transfer fluids can also be used if desired.

Analysis has shown that the final COPs for the embodiments of this invention can be at least about 90% of the ideal COPs. The improved results of this invention are due primarily to the low thermal gradients in the canisters achieved through the improved regenerative heat systems of this invention, whereas the large thermal gradients existing in the prior art systems cause inherent large system energy losses. The elimination of such thermal gradients allows a much higher regeneration efficiency for the system. In all systems, however, there are minor losses due to parasitic heat loss from insulated surfaces and small regenerator inefficiencies.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in prefered embodiment and the figures and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. For example, conventional flow systems components such as accumulators and additional pumps and the like can be included in the systems if desired. The claims, therefore, are to be accorded a range of equivalents commensurate in scope with the advances made over the art.

INDUSTRIAL APPLICABILITY

The regenerative hydride heat pump processes and systems of this invention are useful for air conditioning rooms and buildings and can also be used for heating in the winter and producing hot water throughout the year, and in general for pumping heat from a lower temperature to a higher temperature.

TABLE 1

| At the Start of Phase | for FIGS. 2 and 4 1 | 2 | 3 | 4 |
|---|---|---|---|---|
| The Open Valves are | 140D | 140A | 140B | 140C |
| | 156B | 156C | 156D | 156A |
| | 240B | 240C | 240D | 240A |
| | 256D | 256A | 256B | 256C |
| Causing Canister Nos. | 102D | 102A | 102B | 102C |
| to be at their | 202D | 202A | 202B | 202C |
| Maximum Temperature | | | | |
| Causing Canister Nos. | 102B | 102C | 102D | 102A |
| to be at their | 202B | 202C | 202D | 202A |
| Minimum Temperature | | | | |
| $H_2$ flows out of | 102B | 102C | 102D | 102A |
| Canister Nos. | 202D | 202A | 202B | 202C |
| $H_2$ flows into | 102D | 102A | 102B | 102C |
| Canister Nos. | 202B | 202C | 202D | 202A |

TABLE 2

| Canister No. | Phase 1 | 2 | 3 | 4 |
|---|---|---|---|---|
| | Temperature Profile in the Canister at the Start/End of the Phase | | | |
| 102D | D/A | A/B | B/C | C/D |
| 102C | A/B | B/C | C/D | D/A |
| 102B | B/C | C/D | D/A | A/B |
| 102A | C/D | D/A | A/B | B/C |
| 202D | H/E | E/F | F/G | G/H |
| 202C | E/F | F/G | G/H | H/E |
| 202B | F/G | G/H | H/E | E/F |
| 202A | G/H | H/E | E/F | F/G |

TABLE 3

| At the Start of Phase | for FIG. 1 1 | 2 | 3 | 4 |
|---|---|---|---|---|
| The Open Valves are | 140D | 140A | 140B | 140C |
| | 156B | 156C | 156D | 156A |
| | 240B | 240C | 240D | 240A |
| Heating Device | 208D | 208A | 208B | 208C |
| which is Heating | | | | |
| Causing Canister Nos. | 102D | 102A | 102B | 102C |
| to be at their | 202D | 202A | 202B | 202C |
| Maximum Temperature | | | | |
| Causing Canister Nos. | 102B | 102C | 102D | 102A |
| to be at their | 202B | 202C | 202D | 202A |
| Minimum Temperature | | | | |
| H2 flows out of | 102B | 102C | 102D | 102A |
| Canister Nos. | 202D | 202A | 202B | 202C |
| H2 flows into | 102D | 102A | 102B | 102C |
| Canister Nos. | 202B | 202C | 202D | 202A |

What is claimed is:

1. A regenerative temperature hydride heat pump process for cooling a chamber comprising:

(a) confining a first hydride in a plurality of first reaction zones and maintaining the temperature thereof in a first temperatue range, the number of first reaction zones being at least four;

(b) introducing hydrogen gas from a source of hydrogen gas into a predetermined one of the first reaction zones and sorbing the hydrogen gas on the first hydride therein;

(c) desorbing hydrogen gas from the first hydride in another predetermined one of the first reaction zones and removing the desorbed hydrogen gas therefrom;

(d) transferring heat between the first reaction zones by circulating a first heat transfer fluid in series flow around a loop of the first reaction zones, thereby regenerating heat, while preventing the first heat transfer fluid from directly contacting the first hydride;

(e) transferring heat from the predetermined one of the first reaction zones recited in step (b) to the environment;

(f) transferring heat from a chamber to the another predetermined one of the first reaction zones recited in step (c) thereby aiding the desorption of the first hydride therein;

(g) confining a second hydride in a plurality of second reaction zones and maintaining the temperatures thereof in a second temperature range which is higher than the first temperature range recited in step (a), the number of second reaction zones being equal to the number of first reaction zones;

(h) introducing the desorbed hydrogen gas removed from the another predetermined one of the first reaction zones recited in step (c) into a predetermined one of the second reaction zones and sorbing the hydrogen gas on the second hydride therein;

(i) desorbing hydrogen gas from the second hydride in another predetermined one of the second reaction zones by heating and removing the desorbed hydrogen gas therefrom and using it as the source of hydrogen gas introduced into the predetermined one of the first reaction zones recited in step (b);

(j) transferring heat between the second reaction zones by circulating a second heat transfer fluid in series flow around a loop of the second reaction zones, thereby regenerating heat, while preventing the second heat transfer fluid from directly contacting the second hydride;

(k) transferring heat from the predetermined one of the second reaction zones recited in step (h) to the environment; and, (l) transferring heat from a heat source to the another predetermined one of the second reaction zones recited in step (i) thereby providing a regenerative temperature hydride heat pump process for cooling a chamber.

2. The process of claim 1, further comprising:

(m) advancing, after a predetermined period of time, i. the predetermined one of the first reaction zones to the next first reaction zone in the loop of first reaction zones, ii. the another predetermined one of the first reaction zones to the next first reaction zone in the loop of first reaction zones, iii. the predetermined one of the second reaction zones to the next second reaction zone in the loop of second reaction zones, and iv. the another predetermined one of the second reaction zones to the next second reaction zone in the loop of second reaction zones; and, (n) repeating the advancing of the first and second reaction zones around the loop as recited in step (m).

3. The process of claim 1, wherein the transferring of heat from the predetermined one of the first reaction zones to the environment recited in step (e) comprises:

transferring heat from the predetermined one of the first reaction zones to a third heat transfer fluid; and, transferring heat from the third heat transfer fluid to the environment.

4. The process of claim 1, wherein the transferring of heat from the predetermined one of the first reaction zones to the environment recited in step (e) comprises:

transferring heat from the first heat transfer fluid before, and proximate to, flowing in into the predetermined one of the first reaction zones to a third heat transfer fluid thereby producing a cooled first heat transfer fluid for flowing into the predetermined one of the first reaction zones; and, transferring heat from the third heat transfer fluid to the environment.

5. The process of claim 1, wherein the transferring of heat from the chamber to the another predetermined one of the first reaction zones recited in step (f) comprises:

transferring heat from the chamber to a third heat transfer fluid; and, transferring heat from the third heat transfer fluid to the another predetermined one of the first reaction zones.

6. The process of claim 1, wherein the transferring of heat from the chamber to the another predetermined one of the first reaction zones recited in step (f) comprises:

transferring heat from the chamber to a third heat transfer fluid; and, transferring heat from the third heat transfer fluid to the first heat transfer fluid before, and proximate to, flowing it into the another predetermined one of the first reaction zones thereby producing a heated first heat transfer fluid for flowing into the another predetermined one of the first reaction zones.

7. The process of claim 1, wherein the transferring of heat from the predetermined one of the second reaction zones to the environment recited in step (k) comprises:

transferring heat from the predetermined one of the second reaction zones to a third heat transfer fluid; and, transferring heat from the third heat transfer fluid to the environment.

8. The process of claim 1, wherein the transferring of heat from the predetermined one of the second reaction zones to the environment recited in step (k) comprises:

transferring heat from the second heat transfer fluid before, and proximate to, flowing it into the predetermined one of the second reaction zones to a third heat transfer fluid thereby producing a cooled second heat transfer fluid for flowing into the predetermined one of the second reaction zones; and, transferring heat from the third heat transfer fluid to the environment.

9. The process of claim 1, wherein the transferring of heat from a heat source to the another predetermined one of the second reaction zones recited in step (l) comprises transferring heat from the heat source to the second heat transfer fluid before, and proximate to, flowing it into the another predetermined one of the second reaction zones.

10. The process of claim 1, wherein the transferring of heat from a heat source to the another predetermined one of the second reaction zones recited in step (l) comprises:

transferring heat from the heat source to a third heat transfer fluid; and, transferring heat from the third heat transfer fluid to the another predetermined one of the second reaction zones.

11. The process of claim 1, wherein the transferring of heat from a heat source to the another predetermined one of the second reaction zones recited in step (l) comprises:

transferring heat from the heat source to a third heat transfer fluid; and, transferring heat from the third heat transfer fluid to the second heat transfer fluid before, and proximate to, flowing it into the another predetermined one of the second reaction zones thereby producing a heated second heat transfer fluid for flowing into the another predetermined one of the second reaction zones.

12. The process of claim 1, wherein the first hydride is FeTiH and the second hydride is $LaNi_{4.7}Alo._3H_3$.

13. A regenerative temperature hydride heat pump process for cooling a room comprising:

(a) confining a first hydride in a plurality of first reaction zones and maintaining the temperatures thereof in a first temperature range, the number of first reaction zones being at least four;

(b) introducing hydrogen gas from a source of hydrogen gas into a predetermined one of the first reaction zones and sorbing the hydrogen gas on the first hydride therein;

(c) desorbing hydrogen gas from the first hydride in another predetermined one of the first reaction zones and removing the desorbed hydrogen gas therefrom;

(d) continuously transferring heat between the first reaction zones by circulating a first heat transfer fluid in series flow around a loop of the first reaction zones, thereby regenerating heat, while preventing the first heat transfer fluid from directly contacting the first hydride;

(e) transferring heat from the predetermined one of the first reaction zones recited in step (b) to the environment;

(f) transferring heat from the room to a second heat transfer fluid;

(g) transferring heat from the second heat tranfer fluid to the another predetermined one of the first reaction zones recited in step (c) thereby aiding the desorption of the first hydride therein;

(h) confining a second hydride in a plurality of second reaction zones and maintaining the temperatures thereof in a second temperature range which is higher than the first temperature range recited in step (a), the number of second reaction zones being equal to the number of first reaction zones;

(i) introducing the desorbed hydrogen gas removed from the another predetermined one of the first reaction zones recited in step (c) into a predetermined one of the second reaction zones and sorbing the hydrogen gas on the second hydride therein;

(j) desorbing hydrogen gas from the second hydride in another predetermined one of the second reaction zones by heating and removing the desorbed hydrogen gas therefrom and using it as the source of hydrogen gas introduced into the predetermined one of the first reaction zones recited in step (b);

(k) continuously transferring heat between the second reaction zones by circulating a third heat transfer fluid in series flow around a loop of the second reaction zones, thereby regenerating heat, while preventing the third heat transfer fluid from directly contacting the second hydride;

(l) transferring heat from the predetermined one of the second reaction zones recited in step (i) to the environment;

(m) transferring heat from a heat source to the another predetermined one of the second reaction zones recited in step (j);

(n) advancing, after a predetermined period of time, i. the predetermined one of the first reaction zones to the next first reaction zone in the loop of first reaction zones, ii. the another predetermined one of the first reaction zones to the next first reaction zone in the loop of first reaction zones, iii. the predetermined one of the second reaction zones to the next second reaction zone in the loop of second reaction zones, and iv. the another predetermined one of the second reaction zones to the next second reaction zone in the loop of second reaction zones; and, (o) repeating the advancing of the first and second reaction zones around the loop as recited in step (n), thereby providing a regenerative temperature hydride heat pump process for cooling the room.

14. The process of claim 13, wherein the transferring of heat from the predetermined one of the first reaction zones to the environment recited in step (e) comprises:

transferring heat from the predetermined one of the first reaction zones to a fourth heat transfer fluid; and, transferring heat from the fourth heat transfer fluid to the environment.

15. The process of claim 13, wherein the transferring of heat from the predetermined one of the second reaction zones to the environment recited in step (l) comprises:

transferring heat from the predetermined one of the second reaction zones to a fourth heat transfer fluid; and, transferring heat from the fourth heat transfer fluid to the environment.

16. The process of claim 13, wherein the transferring of heat from a heat source to the another predetermined one of the second reaction zones recited in step (m) comprises;

transferring heat from the heat source to a fourth heat transfer fluid; and, transferring heat from the fourth heat transfer fluid to the another predetermined one of the second reaction zones.

17. A regenerative low temperature hydride heat pump process for cooling a room comprising:

(a) confining a first hydride in a plurality of first reaction zones and maintaining the temperatures thereof in a first temperature range, the number of first reaction zones being at least four;

(b) introducing hydrogen gas from a source of hydrogen gas into a predetermined one of the first reaction zones and sorbing the hydrogen gas on the first hydride therein;

(c) desorbing hydrogen gas from the first hydride in another predetermined one of the first reaction zones and removing the desorbed hydrogen gas therefrom;

(d) continuously transferring heat between the first reaction zones by circulating a first heat transfer fluid in series flow around a loop of the first reaction zones, thereby regenerating heat, while preventing the first heat transfer fluid from directly contacting the first hydride;

(e) transferring heat from the predetermined one of the first reaction zones recited in step (b) to a second heat transfer fluid;

(f) transferring heat from the second heat transfer fluid to the environment;

(g) transferring heat from the room to a third heat transfer fluid;

(h) transferring heat from the third heat transfer fluid to the another predetermined one of the first reaction zones recited in step (c) thereby aiding the desorption of the first hydride therein;

(i) confining a second hydride in a plurality of second reaction zones and maintaining the temperatures thereof in a second temperature range which is higher than the first temperature range recited in step (a), the number of second reaction zones being equal to the number of first reaction zones;

(j) introducing the desorbed hydrogen gas removed from the another predetermined one of the first reaction zones recited in step (c) into a predetermined one of the second reaction zones and sorbing the hydrogen gas on the second hydride therein;

(k) desorbing hydrogen gas from the second hydride in another predetermined one of the second reaction zones by heating and removing the desorbed hydrogen gas therefrom and using it as the source of hydrogen gas introduced into the predetermined one of the first reaction zones recited in step (b);

(l) continuously transferring heat between the second reaction zones by circulating a fourth heat transfer fluid in series flow around a loop of the second reaction zones, thereby regenerating heat, while preventing the fourth heat transfer fluid from directly contacting the second hydride;

(m) transferring heat from the predetermined one of the second reaction zones recited in step (j) to a fifth heat transfer fluid;

(n) transferring heat from the fifth heat transfer fluid to the environment;

(o) transferring heat from the heat source to a sixth heat transfer fluid;

(p) transferring heat from the sixth heat transfer fluid to the another predetermined one of the second reaction zones in step (k);

(q) advancing, after a predetermined period of time, i. the predetermined one of the first reaction zones to the next first reaction zone in the loop of first reaction zones, ii. the another predetermined one of the first reaction zones to the next first reaction zone in the loop of first reaction zones, iii. the predetermined one of the second reaction zones to the next second reaction zone in the loop of second reaction zones, and, iv. the another predetermined one of the second reaction zones to the next second reaction zone in the loop of second reaction zones; and, (r) repeating the advancing of the first and second reaction zones around the loop as recited in step (q), thereby providing a regenerative low temperature hydride heat pump process for cooling the room.

18. A regenerative temperature hydride heat pump system for cooling a chamber comprising:

a plurality of first canisters, the number of first canisters being at least four, each of the first canisters having a first hydride contained therein, and a first heat conductive passageway for indirectly transferring heat between the first hydride and a heat transfer fluid in the passageway without direct contact between the heat transfer fluid and the first hydride;

a plurality of first indirect heat exchange means, the number of first indirect heat exchange means being equal to the number of first canisters, each of the first indirect heat exchange means having a first channel for flowing a heat transfer fluid, and a second channel for flowing a heat transfer fluid, the channels being isolated from fluid communication with each other, the first channel being in heat conductive communication with the second channel, each of the channels having an inlet and an outlet;

a first train which comprises the first channels and the first heat conductive passageways formed by connecting in alterating order the first channels of the first indirect heat exchange means to the first heat conductive passageways;

first pumping means for pumping a first heat transfer fluid around the first train;

second pumping means for pumping a second heat transfer fluid;

connecting means for connecting the outlet of the second pumping means to the inlet of the second channel of each of the first internal heat exchange means, and the outlet of each of the second channels thereof to the inlet of the second pumping means;

control means for directing the second heat transfer fluid to the second channel of a predetermined one of the first indirect heat exchange means;

first heat discharge means for transferring heat from the second heat transfer fluid to the environment;

chamber cooling means for transferring heat from a chamber to each of the first canisters in a predetermined order;

a plurality of second canisters, the number of second canisters being equal to the number of first canisters, each of the second canisters having a second hydride contained therein, the second hydride requiring a higher temperature for desorption of hydrogen gas than the temperature for desorption of hydrogen gas from the first hydride, and a second heat conductive passageway for indirectly transferring heat between the second hydride and a heat transfer fluid in the second heat conductive passageway without direct contact between the heat transfer fluid therein and the second hydride;

means for transferring hydrogen gas between the first canisters and the second canisters;

a plurality of second indirect heat exchange means, the number of second indirect heat exchange means being equal to the number of second canisters, each of the second indirect heat exchange means having a first channel for flowing a heat transfer fluid, and a second channel for flowing a heat transfer fluid, the channels thereof being isolated from fluid communication with each other, the first channel thereof being in heat conductive communication with the second channel thereof, each of the channels having an inlet and an outlet;

a second train which comprises the first channels of the second indirect heat exchange means and the second heat conductive passageways formed by connecting in alternating order the first channels of the second indirect heat exhange means to the second heat conductive passageways;

third pumping means for pumping a third heat transfer fluid around the second train;

fourth pumping means for pumping a fourth heat transfer fluid;

connecting means for connecting the outlet of the fourth pumping means to the inlet of the second channel of each of the second indirect heat exchange means, and the outlet of each of the second channels thereof to the inlet of the fourth pumping means;

control means for directing the fourth heat transfer fluid to the second channel of a predetermined one of the second indirect heat exchange means;

second heat discharge means for transferring heat from the fourth heat transfer fluid to the environment; and, heating means for transferring heat into each of the second canisters in a predetermined order, thereby providing a regenerative temperature hydride heat pump system for cooling a chamber.

19. The system of claim 18, wherein the number of first canisters is four and the number of second canisters is four.

20. The system of claim 18, wherein the number of first canisters is six and the number of second canisters is six.

21. The system of claim 18, wherein the first heat discharge means is a radiator and wherein the second heat discharge means is a radiator.

22. The system of claim 18, wherein the chamber cooling means comprises means for transferring heat from the chamber to a fifth heat transfer fluid; and, means for transferring heat from the fifth heat transfer fluid to a predetermined one of the first canisters.

23. The system of claim 18, wherein the chamber cooling means comprises means for transferring heat from the chamber to a fifth heat transfer fluid; means for transferring heat from the fifth heat transfer fluid to the first heat transfer fluid; and, means for transferring heat from the first heat transfer fluid to a predetermined one of the first canisters.

24. The system of claim 18, wherein each of the first indirect heat exchange means has a third channel for flowing a heat transfer fluid, the third channel being isolated from fluid communication with the first channel thereof and the second channel thereof, the first channel being in heat conductive communication with the third channel, the third channel having an inlet and an outlet; and, further comprising fifth pumping means for pumping a fifth transfer fluid;

connecting means for connecting the outlet of the fifth pumping means to the inlet of the third channel of each of the first internal heat exchange means, and the outlet of each of the third channels thereof to the inlet of the fifth pumping means;

control means for directing the third heat transfer fluid to the third channel of a predetermined one of the first indirect heat exchange means; and, wherein the chamber cooling means for transferring heat from a chamber to each of the first canisters comprises means for transferring heat from the chamber to the fifth heat transfer fluid.

25. The system of claim 18, wherein the heating means comprises means for heating a fifth heat transfer fluid; and, means for transferring heat from the fifth heat transfer fluid to a predetermined one of the second canisters.

26. The system of claim 18, wherein the heating means comprises means for heating a fifth heat transfer fluid; means for transferring heat from the fifth heat transfer fluid to the third heat transfer fluid; and, means for transferring heat from the third heat transfer fluid to a predetermined one of the second canisters.

27. The system of claim 18, wherein each of the second indirect heat exchange means has a third channel for flowing a heat transfer fluid, the third channel being isolated from fluid communication with the first channel thereof and the second channel thereof, the third channel being in heat conductive communication with the first channel thereof, the third channel having an inlet and an outlet; and, further comprising fifth pumping means for pumping a fifth heat transfer fluid;

connecting means for connecting the outlet of the fifth pumping means to the inlet of the third channel of each of the second indirect heat exchange means, and the outlet of each of the third channels thereof to the inlet of the fifth pumping means;

control means for directing the fifth heat transfer fluid to the third channel of a predetermined one of the second indirect heat exchange means; and, wherein the heating means comprises means for heating the fifth heat transfer fluid.

28. The system of claim 18, wherein the first hydride is FeTiH and the second hydride is $LaNi_{4.7}Al_{0.3}H_3$.

29. A regenerative low temperature hydride heat pump system for cooling a room comprising:

a plurality of first canisters, the number of first canisters being at least four, each of the first canisters having a first hydride contained therein, and a first heat conductive passageway for indirectly transferring heat between the first hydride and a heat transfer fluid in the passageway without direct contact between the heat transfer fluid and the first hydride;

a plurality of first indirect heat exchange means, the number of first indirect heat exchange means being equal to the number of first canisters, each of the first indirect heat exchange means having a first channel for flowing a heat transfer fluid, a second channel for flowing a heat transfer fluid, and a third channel for flowing a heat transfer fluid, the channels being isolated from fluid communication with each other, the first channel being in heat conductive communication with the second channel and the third channel, each of the channels having an inlet and an outlet;

a first train which comprises the first channels and the first heat conductive passageways formed by connecting in alternating order the first channels of the first indirect heat exchange means to the first heat conductive passageways;

first pumping means for pumping a first heat transfer fluid around the first train;

second pumping means for pumping a second heat transfer fluid;

connecting means for connecting the oulet of the second pumping means to the inlet of the second channel of each of the first internal heat exchange means, and the outlet of each of the second channels thereof to the inlet of the second pumping means;

control means for directing the second heat transfer fluid to the second channel of a predetermined one of the first indirect heat exchange means;

first heat discharge means for transferring heat from the second heat transfer fluid to the environment;

third pumping means for pumping a third heat transfer fluid;

connecting means for connecting the outlet of the third pumping means to the inlet of the third channel of each of the first internal heat exchange means, and the outlet of each of the third channels thereof to the inlet of the third pumping means;

control means for directing the third heat transfer fluid to the third channel of a predetermined one of the first indirect heat exchange means;

room cooling means for transferring heat from a room to the third heat transfer fluid;

a plurality of second canisters, the number of second canisters being equal to the number of first canisters, each of the second canisters having a second hydride contained therein, the second hydride requiring a higher temperature for desorption of hydrogen gas than the temperature for desorption of hydrogen gas from the first hydride, and a second heat conductive passageway for indirectly transferring heat between the second hydride and a heat transfer fluid in the second heat conductive passageway without direct contact between the heat transfer fluid therein and the second hydride;

means for transferring hydrogen gas between the first canisters and the second canisters;

a plurality of second indirect heat exchange means, the number of second indirect heat exchange means being equal to the number of second canisters, each of the second indirect heat exchange means having a first channel for flowing a heat transfer fluid. a second channel for flowing a heat transfer fluid, and a third channel for flowing a heat transfer fluid, the channels thereof being isolated from fluid communication with each other, the first channel thereof being in heat conductive communication with the second channel thereof and the third channel thereof, each of the channels having an inlet and an outlet;

a second train which comprises the first channels of the second indirect heat exchange means and the second heat conductive passageways formed by connecting in alternating order the first channels of the second indirect heat exchange means to the second heat conductive passageways;

fourth pumping means for pumping a fourth heat transfer fluid around the second train;

fifth pumping means for pumping a fifth heat transfer fluid;

connecting means for connecting the outlet of the fifth pumping means to the inlet of the second channel of each of the second indirect heat exchange means, and the outlet of each of the second channels thereof to the inlet of the fifth pumping means;

control means for directing the fifth heat transfer fluid to the second channel of a predetermined one of the second indirect heat exchange means;

second heat discharge means for transferring heat from the fifth heat transfer fluid to the environment;

sixth pumping means for pumping a sixth heat transfer fluid;

connecting means for connecting the outlet of the sixth pumping means to the inlet of the third channel of each of the second indirect heat exchange means, and the outlet of each of the third channels thereof to the inlet of the sixth pumping means;

control means for directing the sixth heat transfer fluid to the third channel of a predetermined one of the second indirect heat exchange means; and, heating means for introducing heat into the system includes means for heating the sixth heat transfer fluid, thereby providing a regenerative low temperature hydride heat pump system for cooling a room.

30. A regenerative low temperature hydride heat pump system for cooling a room comprising:

a plurality of first canisters, the number of first canisters being at least four, each of the first canisters having a first hydride contained therein, and a first heat conductive passageway for indirectly transferring heat between the first hydride and a heat transfer fluid in the passageway without direct contact between the heat transfer fluid and the first hydride;

a plurality of first indirect heat exchange means, the number of first indirect heat exchange means being equal to the number of first canisters, each of the first indirect heat exchange means having a first channel, a second channel, and a third channel, the channels being isolated from immediate fluid communication with each other, the first channel being in heat conductive communication with the second channel and the third channel, each of the channels having an inlet and an outlet;

a first train which comprises the first channels and the first heat conductive passageways formed by connecting in alternating order the first channels of the first indirect heat exchange means to the first heat conductive passageways;

a plurality of second canisters, the number of second canisters being equal to the number of first canisters, each of the second canisters having a second hydride contained therein, the second hydride requiring a higher temperature for desorption of hydrogen gas than the temperature for desorption of hydrogen gas from the first hydride, and a second heat conductive passageway for indirectly transferring heat between the second hydride and a heat transfer fluid in the second heat conductive passageway without direct contact between the heat transfer fluid therein and the second hydride;

means for transferring hydrogen gas between the first canisters and the second canisters;

a plurality of second indirect heat exchange means, the number of second indirect heat exchange means being equal to the number of second canisters, each of the second indirect heat exchange means having a first channel, a second channel, and a third channel, the channels thereof being isolated from immediate fluid communication with each other, the first channel thereof being in heat conductive communication with the second channel thereof and the third channel thereof, each of the channels having an inlet and an outlet;

a second train which comprises the first channels of the second indirect heat exchange means and the second heat conductive passageways formed by connecting in alternating order the first channels of the second indirect heat exchange means to the second heat conductive passageways;

first connecting means for connecting the outlet of the second train to the inlet of the first train;

second connecting means for connecting the outlet of the first train to the inlet of the third channel of each of the second indirect heat exchange means;

heating means for introducting heat into the system includes means for heating the heat transfer fluid in the second connecting means;

third connecting means for connecting the oulet of the third channel of each of the second indirect heat exchange means to the inlet of the third channel of each of the first indirect heat exchange means;

room cooling means for transferring heat from a room to the heat transfer fluid in the third connecting means;

fourth connecting means for connecting the outlet of the third channel of each of the first indirect heat exchange means to the inlet of the second channel of each of the first indirect heat exchange means;

fifth connecting means for connecting the outlet of the second channel of each of the first indirect heat exchange means to the inlet of the second channel of each of the second indirect heat exchange means;

first heat discharge means for transferring heat from the heat transfer fluid in the fifth connecting means to the environment;

second heat discharge means for transferring heat from the heat transfer fluid in the second connecting means to the environment;

sixth connecting means for connecting the outlet of the second channel of each of the second indirect heat exchange means to the inlet of the second train thereby forming a closed loop;

pumping means for pumping the heat transfer fluid around the closed loop;

control means for directing the heat transfer fluid to the second channel of a predetermined one of the first indirect heat exchange means;

control means for directing the heat transfer fluid to the third channel of a predetermined one of the first indirect heat exhange means;

control means for directing the heat transfer fluid to the second channel of a predetermined one of the second indirect heat exchange means;

control means for directing the heat transfer fluid to the third channel of a predetermined one of the second indirect heat exchange means;

first auxiliary heat exchanger means for indirectly exchanging heat between the heat transfer fluid flowing in the first connecting means and the heat transfer fluid flowing in the second connecting means;

second auxiliary heat exchanger means for indirectly exchanging heat between the heat transfer fluid flowing in the second connecting means and the heat transfer fluid flowing in the third connecting means;

third auxiliary heat exchanger means for indirectly exchanging heat between the heat transfer fluid flowing in the second connecting means and the heat transfer fluid flowing in the sixth connecting means; and, fourth auxiliary heat exchanger means for indirectly exchanging heat between the heat transfer fluid flowing in the third connecting means and the heat transfer fluid flowing in the fourth connecting means, thereby providing a regenerative low temperature hydride heat pump system for cooling a room.

31. The system of claim 30, wherein the pumping means is in the second connecting means.

32. The system of claim 30, wherein the second connecting means contains first, relative to the direction of flow of the heat transfer fluid therein, the first auxiliary heat exchanger means, then the third auxiliary heat exchanger means, then the second heat discharge means, then the pumping means, then the second auxiliary heat exchanger means, and last the heating means; and wherein the third connecting means contains first, relative to the direction of flow of the heat transfer fluid therein, the second auxiliary heat exchanger means, then the fourth auxiliary heat exchanger means, and last the room cooling heating means.

* * * * *